US006530649B1

(12) United States Patent
Pan

(10) Patent No.: US 6,530,649 B1
(45) Date of Patent: Mar. 11, 2003

(54) HERMETIC SEAL IN MICROELECTRONIC DEVICES

(75) Inventor: Alfred I-Tsung Pan, Palo Alto, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/930,228

(22) Filed: Aug. 16, 2001

(51) Int. Cl.[7] ..... B41J 2/05
(52) U.S. Cl. ..... 347/56
(58) Field of Search ..... 347/63, 50, 56, 347/13, 66, 42; 239/548; 361/761

(56) References Cited

U.S. PATENT DOCUMENTS 5,992,769 A * 11/1999 Wise et al. ..... 239/548
6,366,468 B1 * 4/2002 Pan ..... 361/761
6,402,301 B1 * 6/2002 Powers et al. ..... 347/63

* cited by examiner

*Primary Examiner*—Anh T. N. Vo

(57) ABSTRACT

A carrier includes a substrate formed to accept microelectronic chips at various pockets in the substrate. The microelectronic chips are hermetically sealed within the substrate by a deposition process using localized energy supplied at gaps between the chips and the pockets. During the heating process, seal material is deposited in the gaps to form the hermetic seals.

19 Claims, 3 Drawing Sheets

HERMETIC SEAL IN MICROELECTRONIC DEVICES

TECHNICAL FIELD

The technical field is microelectronic devices and methods for producing microelectronic devices. More specifically, the technical field is hermetic seals for microelectronic devices.

BACKGROUND

Inkjet printers are used to produce text and images on a variety of media such as paper, transparencies and labels. A typical inkjet printer uses a carriage that holds one or more ink cartridges. The ink that is to be printed on the media is forced through small holes in thermal inkjet (TIJ) chips to produce the desired text or image. Thermal inkjet chips are small crystal structures that are placed in a larger substrate to provide the desired array of inkjet printing nozzles. The chips include an interconnect to route signals from a front side of the substrate to a backside of the substrate.

The ink used in many inkjet printers is corrosive, and the interconnect and the materials used to form the substrate may be subject to failure due to the corrosive effect of the ink. Adhesives may be used to fill the peripheral gaps between the TIJ chips and the substrate, and may prevent the flow of ink between the TIJ chips and the substrate. Adhesives may also provide some protection for other components in an inkjet printer. Adhesives, however, have several disadvantages. One disadvantage is that conventional adhesives may corrode when exposed to ink. Conventional adhesives also fail to provide a hermetic seal, and may allow ink to pass into and through the peripheral gaps.

A need therefore exists for a corrosion resistant hermetic seal between a chip and a substrate.

SUMMARY

According to a first aspect, a carrier includes chips hermetically sealed within pockets in a substrate. A chip is hermetically sealed to the substrate by depositing seal material in a peripheral gap between the chip and the substrate. The seal is deposited between the chip and the substrate using localized energy supplied at the peripheral gap. The chips may be, for example, thermal inkjet (TIJ) chips.

According to the first aspect, the deposited seal may be generally resistant to inks used in inkjet printers, and to other corrosive substances. The deposited seal is more stable than adhesive seals. In addition, the hermetic seal prevents corrosive ink from affecting delicate wiring or other fixtures on the chips and on the substrate.

Also according to the first aspect, the use of localized energy reduces the chance that carrier components will be damaged by the deposition process. For example, if the localized energy is localized heating at the peripheral gap, the heating can be maintained in a controlled area. Therefore, wiring, fixtures, or other components on the carrier are not unnecessarily exposed to the heat energy used in the deposition process.

Other aspects and advantages will become apparent from the following detailed description, taken in conjunction with the accompanying drawings.

DESCRIPTION OF THE DRAWINGS

The detailed description will refer to the following drawings, in which like numerals refer to like elements, and in which.

DETAILED DESCRIPTION

A seal deposited between a chip and a substrate provides a hermetic seal between the chip and the substrate. The hermetic seal may be used in a variety of applications, and provides significant advantages. One such application is in a carrier for an inkjet printer. In the inkjet printer embodiment, hermetic seals are formed between thermal inkjet (TIJ) chips and a substrate.

Figure 1:
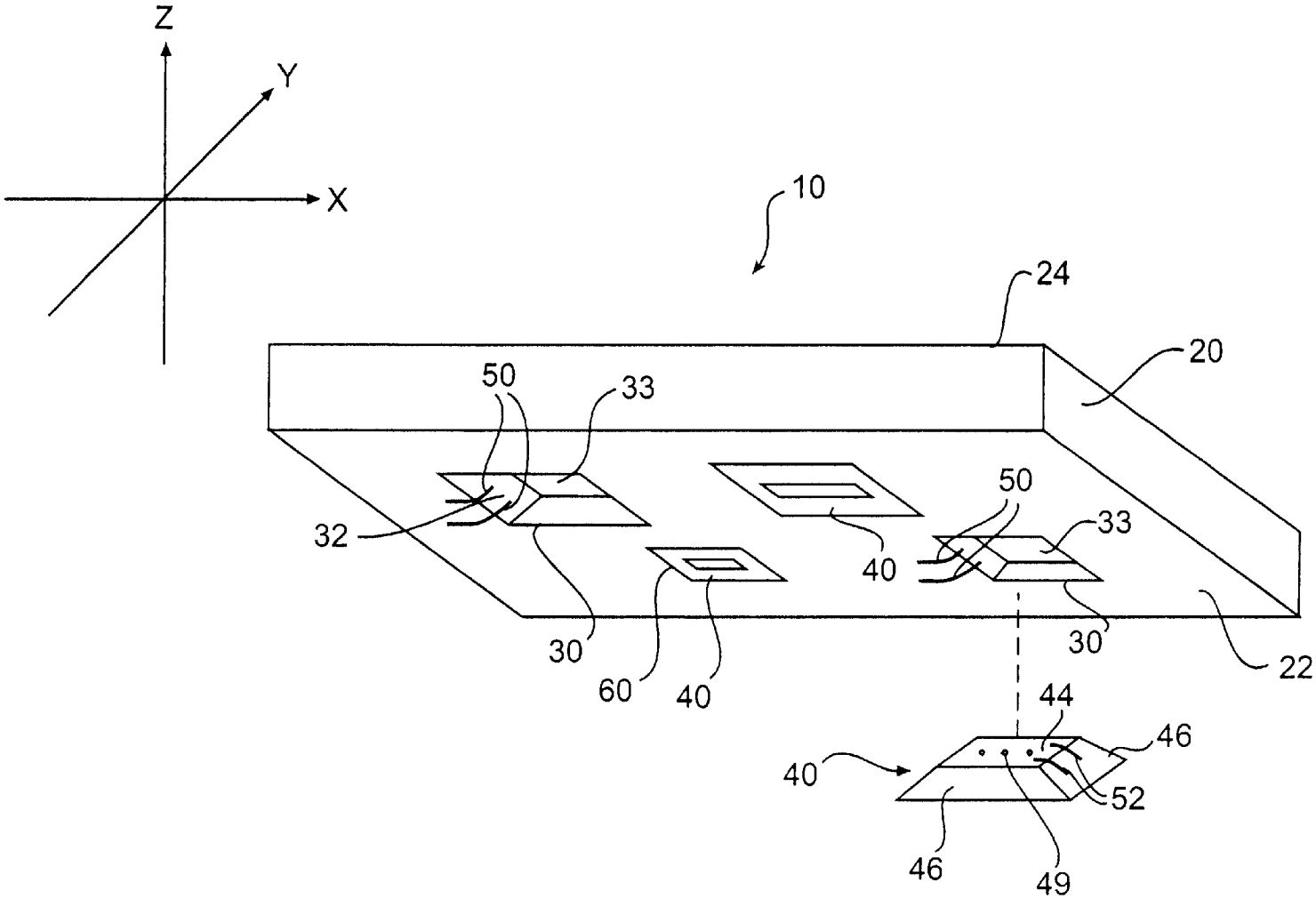
FIG. 1 is a perspective view of a carrier comprising a substrate and chips.

FIG. 1 is a perspective view of a carrier 10 suitable for use in an inkjet printer. The carrier 10 includes a substrate 20 having a bottom or mounting side 22, a top side 24, and chips 40. The chips 40 may be, for example, TIJ chips.

The bottom side 22 of the substrate 20 receives ink from the inkjet printer, and the top side 24 faces the media (e.g., paper) on which desired text or images are to be printed. A plurality of pockets 30 are cut into the substrate 20, each pocket being designed to accommodate a chip 40. Each of the pockets 30 may include an aperture 33 that provides a passage from the bottom side 22 to the top side 24. Each of the pockets 30 may include first side profiles 32 formed in the pocket 30. The chips 40 may include side profiles 46 that are complimentary to the side profiles 32.

Each chip 40 also includes holes 49 through which ink drops are ejected through a top surface 44, leads 52 to effectuate ink transfer, and a base surface 42 (illustrated in FIG. 4B) in contact with an ink supply (not shown). In FIG. 1, the chips 40 and the pockets 30 are shown with two conductive leads (two each of 52 and 50, respectively). However, any number of wiring leads may be patterned on the chips 40 and on the substrate 20 at the pockets 30. The leads 50 and 52 are electrically connected when the chips 40 are inserted in the substrate 20. The leads 50, 52 may be electrically connected by press fitting, or by applying solder 61 (see FIG. 2). The leads 50, 52 are used to route signals from one side of the substrate 20 to the other.

Seals 60 seal the peripheral gaps between the mounted chips 40 and the substrate 20, and retain the chips 40 in the pockets 30. The seals 60 may advantageously be made by a deposition process performed using localized energy. The deposition process creates hermetic seals 60 between the chips 40 and the substrate 20. A seal 60 is discussed in detail below with reference to FIG. 2.

Figure 2:
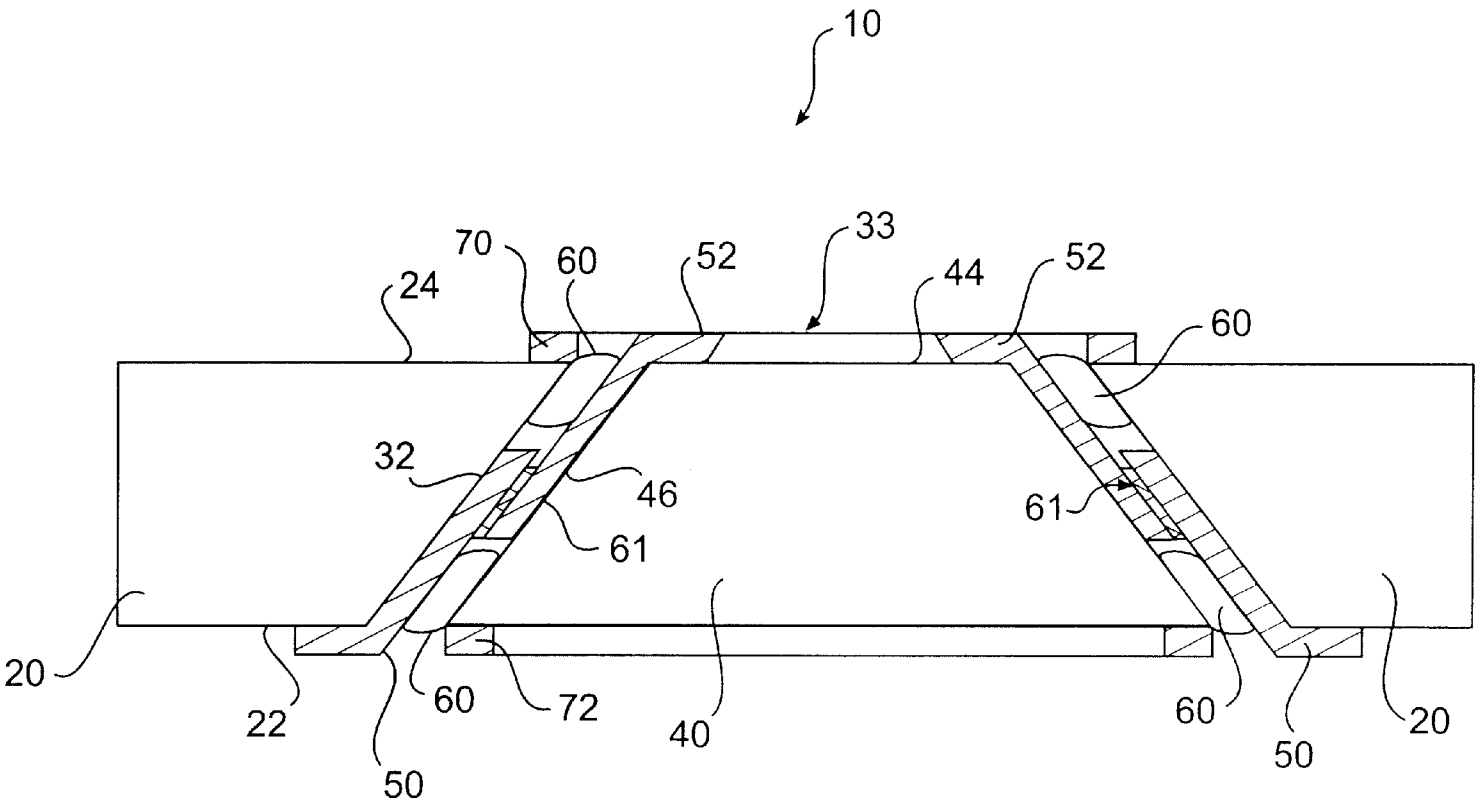
FIG. 2 is a cross-sectional side view of the carrier of FIG. 1.

FIG. 2 is a side cross-sectional view of a portion of the carrier 10 showing a seal 60 in a peripheral gap between a chip 40 and the substrate 20. In FIG. 2, the seal 60 is illustrated as sealing the peripheral gap near the top side surface 24 and the bottom side surface 22. Alternatively, the seal 60 can fill the entire peripheral gap between the chip 40 and the substrate 20. The seal 60 forms a hermetic seal between the top side surface 24 and the bottom side surface 22.

In the embodiment illustrated in FIG. 2, a heating device 70 is formed on the substrate 20 and a heating device 72 is formed on the chip 40. The heating devices 70, 72 may be, for example, small conductive elements known as "microheaters." During a deposition process, current is passed through the heating devices 70, 72 in order to heat the chip 40 and the substrate 20 at the peripheral gap. The heating devices 70, 72 provide localized heat energy, which causes deposition gases to break down and to deposit seal material in the peripheral gap.

The seal 60 prevents ink from leaking through the peripheral gaps between the chips 40 and the substrate 20. This feature is desirable because inks used in inkjet printers may be corrosive, and may damage the conductive leads 50, 52 and other fixtures on the substrate 20 and on the chips 40. If the chip 40 is an inkjet printhead (i.e., a TIJ chip), then sealing the peripheral gaps also prevents the chips 40 from being pushed out of the pockets 30 by ink (not shown) supplied to the chip 40.

The seals 60 can be formed of corrosion resistant materials. For example, the seals 60 can be polysilicon deposited during an $SiH_4$ chemical vapor deposition (CVD) process. Other suitable deposition gases are discussed in detail below. The seals 60 can also be formed from deposited metals. Examples of suitable metals include aluminum, titanium, copper, platinum, tungsten, and other metals. The seals 60 may be formed in situ in the peripheral gap by local heating generated by the heating devices 70, 72. The use of local heating is desirable because portions of the carrier 10 may be sensitive to high temperatures. Local heating reduces the chance that components of the carrier 10 will be damaged during the deposition process. In other embodiments, localized energy for deposition may be provided using lasers.

Figure 3A:
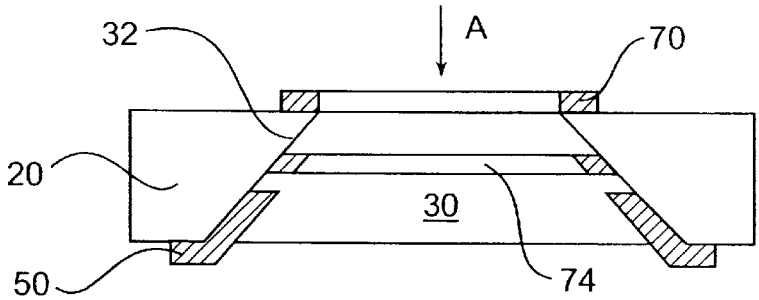
FIG. 3A is a cross-sectional side view of a pocket of the substrate illustrated in FIG. 1.
Figure 3B:
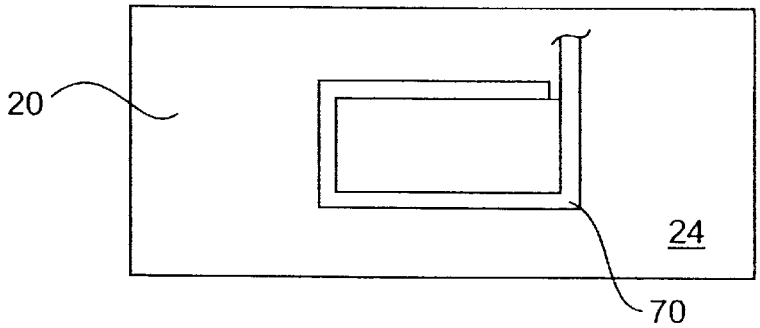
FIG. 3B is a plan view of a top side of the substrate illustrated in FIG. 3A.

FIGS. 3A and 3B illustrate a possible arrangement for heating devices on the substrate 20. FIG. 3A is a cross-sectional side view of a pocket 30 of the substrate 20, and FIG. 3B is a plan view of the top side 24 of the substrate 20 surrounding the pocket 30. The substrate 20 includes resistive heating devices 70, 74 disposed on surfaces of the substrate 20. A first heating device is 70 is patterned on the top side of the substrate 20, and a second heating device 74 is patterned on a side profile 32. The heating devices 70, 74 include leads that connect to external power supplies (not shown). The heating devices 70, 74 can be arranged in any configuration on the substrate 20, and the configuration may vary according to the desired shape for the seal 60.

The heating devices 70, 74 can be formed by, for example, a patterning process. The heating devices 70, 74 and the leads 50 can be formed using the same mask.

Figure 4A:
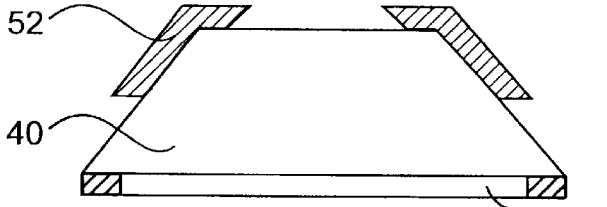
FIG. 4A is a cross-sectional side view of a chip.
Figure 4B:
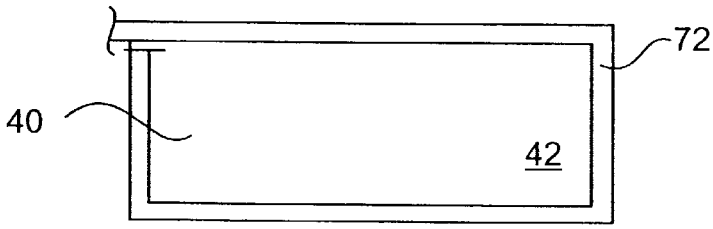
FIG. 4B is a plan view of a top side of the chip illustrated in FIG. 4A.

FIGS. 4A and 4B illustrate a possible arrangement for heating devices on the chip 40. FIG. 4A is a cross-sectional side view of a chip 40, and FIG. 4B is a plan view of a base 42 of the chip 40. The chip 40 includes a resistive heating device 72 formed on the base 42 of the chip 40. The heating device 72 includes a lead that connects to an external power supply (not shown). The heating device 72 can be arranged in any configuration on the chip 40, and the configuration may vary according to the desired shape for the seal 60. The heating device 72 can be formed by, for example, a patterning process. The heating device 72 and the leads 52 can be formed using the same mask.

The number and arrangement of heating devices illustrated in FIGS. 3A, 3B, 4A, and 4B is exemplary, and any configuration of heating devices can be utilized to obtain local heating at the peripheral gap between the chip 40 and the substrate 20. For example, a single heating device disposed in the peripheral gap, on either the substrate 20 or the chip 40, may be sufficient to form a seal 60 during a deposition process. Alternatively, a greater number of heating devices can be formed on the substrate 20 or the chip 40 to obtain a desired seal 60 configuration. In one embodiment, heating devices disposed within the peripheral gap can be activated early in the deposition process to fill a center portion of the peripheral gap with seal material. Subsequently, heating devices at the periphery of the peripheral gap can be activated to complete the seal 60.

The heating devices illustrated in FIGS. 3A, 3B, 4A and 4B can be, for example, microheaters. Microheaters may have a thickness on the order of, for example, 10 $\mu$m in the vicinity of the peripheral gap. The size of the leads to the microheaters increases away from the peripheral gap, to prevent heating outside of the region surrounding the peripheral gap.

The fabrication of the carrier 10 will now be discussed with reference to FIG. 2. The following discussion describes the mounting of a single chip 40 within the substrate 20. The carrier 10 can, however, include any number of chips 40 mounted in the substrate 20.

The chip 40 is first inserted into a pocket 30 so that the conductors 50 on the substrate 20 contact the conductors 52 on the chip 40. The conductors 50, 52 are preferably coated with an insulative material, such as, for example, a dielectric, with a small amount of the insulative material removed where the conductors contact one another. After the chip 40 is inserted in the pocket 30, the solder 61 is applied to electrically connect the conductors 50, 52. As an alternative to solder, the substrate 20 and the chip 40 can be held together under pressure during the fabrication process, with the conductors 50, 52 correspondingly maintaining conductive contact while the seal 60 is formed.

Next, the carrier 10 is exposed to a deposition gas. The heating devices 70, 72 are supplied with current during exposure to the deposition gas. The temperature of the heating devices 70, 72 can be varied according to the desired shape of the seal 60, the deposition gas used to form the seal 60, and the number and arrangement of heating devices formed on the substrate 20 and/or the chip 40.

The deposition gas can be silicon-containing gases such as, for example, $SiH_4$, $SiH_2Cl_2$, and other gases. If $SiH_4$ is used, deposition can be achieved at a temperature of approximately 500 degrees C. The $SiH_4$ breaks down at this temperature and deposits a polysilicon seal 60 in the peripheral gap. Other deposition gases, such as, for example $SiH_4$, may also be used to form a silicon-containing seal 60. The seal 60 may be deposited using, for example, chemical vapor deposition (CVD), photon assisted CVD, laser assisted CVD and other deposition processes.

The seal 60 may also be formed of a metal, such as, for example, aluminum, titanium, copper, platinum, tungsten, and other metals. Deposition gases and temperatures recognized in the art can be used to deposit seals containing the above metals. The seal 60 may be deposited using, for example, metal organic chemical vapor deposition (MOCVD), and other deposition processes.

During deposition, the heating devices 70, 72 are maintained at the desired temperature while the seal 60 is deposited in the peripheral gap.

As an alternative to heating devices, one or more lasers may be aimed at the peripheral gap to provide local heating at the peripheral gap during the deposition process. This is known as "laser-assisted CVD." The lasers can include, for example, an array of lasers capable of heating the peripheral gap to the desired deposition temperature. As another alternative, lasers could be used to break down the deposition gas during deposition, a process known as "photon-assisted CVD." Laser-assisted CVD and photon-assisted CVD can also be used together, and in combination with heating devices. Either laser-assisted CVD or photon-assisted CVD can be used alone to provide localized energy for deposition, in which case heating devices would be unnecessary.

The seal 60 formed during the deposition process is hermetic, and prevents ink from leaking through the peripheral gap between the TIJ chip 40 and the substrate 20. The seal 60 may also be formed from materials that are generally resistant to ink, and to other corrosive materials. The use of a localized energy source reduces the chance that components of the carrier 10 will be damaged during deposition.

In FIG. 1, a plurality of pockets 30 for mounting the chips 40 are illustrated. However, the carrier 10 can include a single pocket 30 for mounting one TIJ chip 40. Alternatively, and as shown, the self-aligned carrier 10 can include a plurality of pockets 30 in which a plurality of chips 40 may be mounted.

While the above embodiments are discussed with reference to a carrier 10 suitable for use in an inkjet printer, the seal 60 may be advantageously employed in any seal process. For example, the seal 60 may be used in any application where a chip is bonded to a substrate. Further, the carrier 10 an be an assembly or subassembly for use in an electronic device.

While the carrier 10 is described with reference to exemplary embodiments, many modifications will be readily apparent to those skilled in the art, and the present disclosure is intended to cover variations thereof.

In the claims:

1. A carrier for an electronic device, comprising:

a substrate having at least one pocket formed in the substrate;

at least one electronic chip, wherein the electronic chip is inserted into the pocket; and at least one seal, wherein the seal is disposed in at least one peripheral gap between the electronic chip and the substrate, and wherein the seal comprises:

seal material deposited in the peripheral gap by one or more localized heating devices providing energy at the peripheral gap.

2. The carrier of claim 1, wherein the seal is deposited in the peripheral gap by local heating within the peripheral gap.

3. The carrier of claim 1, wherein the seal is deposited in the peripheral gap by local heating at a periphery of the peripheral gap.

4. The carrier of claim 1, wherein the seal is deposited in the peripheral gap by photon-assisted deposition at the peripheral gap.

5. The carrier of claim 1, wherein the seal comprises metal.

6. The carrier of claim 1, wherein the seal comprises silicon.

7. The carrier of claim 1, wherein the seal is deposited by a chemical vapor deposition process.

8. The carrier of claim 1, wherein the one or more heating devices are disposed on at least one of the electronic chip or the substrate, wherein heat emitted from the one or more heating devices is the energy, and wherein the heat is capable of raising a temperature of the peripheral gap to a deposition temperature of the seal.

9. The carrier of claim 8, wherein the heating device includes a conductive line connectable to a power source.

10. The carrier of claim 1, wherein the substrate comprises:

first wiring patterned on the substrate at the pocket, wherein the chip comprises patterned second wiring electrically coupled to the first wiring.

11. The carrier of claim 1, wherein the chip is a thermal inkjet chip.

12. A method mounting a chip in a substrate, comprising:

providing a substrate having at least one pocket;

providing at least one electronic chip, wherein the electronic chip is shaped to be received by the substrate;

inserting the electronic chip in the pocket; and providing one or more localized heating devices providing energy at at least one peripheral gap between the substrate and the electronic chip inserted in the pocket; and depositing seal material in the peripheral gap.

13. The method of claim 12, wherein the step of providing localized energy at a peripheral gap comprises:

passing a current through at least one heating device disposed on at least one of the substrate and the electronic chip.

14. The method of claim 13, wherein the step of providing a substrate comprises:

providing a substrate comprising the heating device.

15. The method of claim 13, wherein the step of providing an electronic chip comprises:

providing a chip comprising the heating device.

16. The method of claim 12, wherein the step of providing one or more localized heating devices providing energy at a peripheral gap comprises:

heating the peripheral gap with at least one laser.

17. The method of claim 12, wherein the step of providing one or more localized heating devices providing energy at a peripheral gap comprises:

providing photonic energy to deposition gases at the peripheral gap.

18. A carrier for an electronic device, comprising:

a substrate having at least one pocket formed in the substrate;

at least one electronic chip, wherein the electronic chip is inserted in the pocket;

at least one seal means for sealing at least one peripheral gap between the electronic chip and the substrate; and heating means for raising a temperature of the peripheral gap to a deposition temperature of the seal means.

19. The carrier of claim 18, wherein the seal means is deposited by a chemical vapor deposition process.

* * * * *